US009097079B2

(12) United States Patent
Themig

(10) Patent No.: US 9,097,079 B2
(45) Date of Patent: Aug. 4, 2015

(54) FRACTURING PORT LOCATOR AND ISOLATION TOOL

(75) Inventor: Daniel Jon Themig, Calgary (CA)

(73) Assignee: PACKERS PLUS ENERGY SERVICES INC., Calgary (CA)

( * ) Notice: Subject to any disclaimer, the term of this patent is extended or adjusted under 35 U.S.C. 154(b) by 289 days.

(21) Appl. No.: 13/528,634

(22) Filed: Jun. 20, 2012

(65) Prior Publication Data

US 2012/0325466 A1 Dec. 27, 2012

Related U.S. Application Data

(60) Provisional application No. 61/499,512, filed on Jun. 21, 2011.

(51) Int. Cl.
*E21B 47/09* (2012.01)
*E21B 23/02* (2006.01)

(52) U.S. Cl.
CPC ..... *E21B 23/02* (2013.01); *E21B 47/09* (2013.01)

(58) Field of Classification Search
CPC ..... E21B 47/09; E21B 23/00
USPC ..... 166/255.1
See application file for complete search history.

(56) References Cited

U.S. PATENT DOCUMENTS

| | | | |
|---|---|---|---|
| 3,378,068 | A | 4/1968 | Page, Jr. |
| 5,305,833 | A | 4/1994 | Collins |
| 5,479,989 | A | 1/1996 | Shy et al. |
| 5,549,161 | A | 8/1996 | Gomez et al. |
| 7,543,634 | B2 | 6/2009 | Fehr et al. |
| 7,556,102 | B2 | 7/2009 | Gomez |
| 7,712,538 | B2 | 5/2010 | Fay |
| 7,748,460 | B2 | 7/2010 | Themig et al. |
| 2010/0263873 | A1 | 10/2010 | Turner et al. |
| 2010/0282475 | A1 | 11/2010 | Darnell et al. |

FOREIGN PATENT DOCUMENTS

WO WO 2009/132462 A1 11/2009

*Primary Examiner* — Brad Harcourt
(74) *Attorney, Agent, or Firm* — Bennett Jones LLP

(57) ABSTRACT

A wellbore fluid treatment assembly includes: a tubing string, a fluid port extending through the tubing string wall, the fluid port positioned in a shift gap created by movement of a sliding sleeve valve when opening the fluid port; and a tool for locating the fluid port in the tubing string, the tool including: a body, a locking protrusion encircling a circumference of the body, at least a portion of the locking protrusion having a length measured along the tool's long axis selected to fit into the shift gap.

75 Claims, 6 Drawing Sheets

FRACTURING PORT LOCATOR AND ISOLATION TOOL

FIELD

The invention relates to a method and apparatus for wellbore operations and, in particular, for locating and isolating tubing string fluid ports.

BACKGROUND

Tubing strings are installed into wellbores and provide for conduction therethrough of wellbore treatment fluids and/or produced fluids. Fluids flow into and out of the tubing string via fluid ports through the tubing string wall.

In one previous method, the tubing string includes sliding sleeve valves that are moveable to close and open the fluid ports. Using such tubing strings, the well can be accessed selectively through the fluid ports. For example, once the string is installed, the sliding sleeve valves can be opened for one or more fluid ports. The segments of the well accessed through the opened ports can be isolated and one or more segments may be individually treated so that concentrated and controlled fluid treatment can be provided along the wellbore by injecting the wellbore stimulation fluids from the tubing string through the opened fluid port or ports in the segment and into contact with the formation. After wellbore fluid treatment, the stimulation fluids are sometimes allowed to back flow from the formation into the wellbore tubing string. Thereafter, fluids are produced from the formation. In some embodiments, the produced fluids also enter the tubing string for flow to the surface. Examples of such wellbore treatment systems are described in U.S. Pat. Nos. 7,748,460 and 7,543,634 and PCT application PCT/CA2009/000599.

It may be advantageous in certain circumstances to locate and isolate the opened fluid ports.

SUMMARY

In accordance with a broad aspect of the present invention, there is provided a tool for locating a fluid port in a tubing string, the fluid port being positioned in a shift gap having a known axial length and an inner diameter greater than an inner diameter of the tubing string, the tool comprising: a body including an upper end, a lower end and an outer surface extending therebetween defining an outer diameter, a locking protrusion encircling a circumference of the body, the locking protrusion forming an annular protrusion on the tool with an axial length selected to be at least 60% of the known axial length, the locking protrusion being configurable between an outwardly locked mode and a collapse mode; and a setting mechanism to move the locking protrusion between the outwardly locked mode and the collapse mode.

There is also provided a wellbore assembly for fluid treatment of a well, the wellbore assembly comprising: a tubing string including a tubular wall including an outer surface and an inner wall surface defining an inner diameter, an shift gap in the inner wall surface, the shift gap having a diameter greater than the inner diameter, a fluid port extending through the well providing fluid access between the inner diameter and the outer surface, the fluid port positioned in the shift gap, a sliding sleeve valve slidable in the shift gap between a position closing the fluid port and an open position wherein the fluid port is open to fluid flow therethrough between the inner diameter and the outer surface, the sliding sleeve valve in the open position creating a shift gap in the shift gap in which the fluid port is located, the shift gap having an axial length; and a tool for locating the fluid port in the tubing string, the tool including: a body including an upper end, a lower end and an outer surface extending therebetween defining an outer diameter, a locking protrusion encircling a circumference of the body, at least one of the locking protrusion having a length measured along the tool's long axis, the length being selected to fit into the shift gap.

There is also provided a method for locating a fluid port in a tubing string, the fluid port being positioned in a shift gap from the inner diameter of a tubing string, the method comprising: determining an axial length of a shift gap in the tubing string; running a string with a tool thereon into a wellbore to approximately the depth of the fluid port, the tool including a tool body and a locking protrusion encircling a circumference of the body; locating the tool adjacent the shift gap; and locking the locking protrusion into the shift gap.

It is to be understood that other aspects of the present invention will become readily apparent to those skilled in the art from the following detailed description, wherein various embodiments of the invention are shown and described by way of illustration. As will be realized, the invention is capable for other and different embodiments and its several details are capable of modification in various other respects, all without departing from the spirit and scope of the present invention. Accordingly the drawings and detailed description are to be regarded as illustrative in nature and not as restrictive.

BRIEF DESCRIPTION OF THE DRAWINGS

A further, detailed, description of the invention, briefly described above, will follow by reference to the following drawings of specific embodiments of the invention. These drawings depict only typical embodiments of the invention and are therefore not to be considered limiting of its scope. In the drawings.

DETAILED DESCRIPTION

The description that follows, and the embodiments described therein, is provided by way of illustration of an example, or examples, of particular embodiments of the principles of various aspects of the present invention. These examples are provided for the purposes of explanation, and not of limitation, of those principles and of the invention in its various aspects. The drawings are not necessarily to scale and in some instances proportions may have been exaggerated in order more clearly to depict certain features. Throughout the drawings, from time to time, the same number is used to reference similar, but not necessarily identical, parts.

A method and apparatus has been invented which provides for locating a fluid port in a tubing string, which is positioned in a shift gap. The shift gap is created by movement of a sliding sleeve valve in an annular recess at the fluid port. The existence of a shift gap in the string is indicative of the location of a fluid port. The tool locates a shift gap and may lock into that shift gap.

After locating, the tool and the method may provide for the isolation of the fluid port, testing of well conditions adjacent the fluid port and/or injecting through the fluid port. For example, a seal, which may be carried on the tool can be set below and/or above the fluid port to isolate the fluid port. The seal can be set by applying force to the tool, as by pulling on the string to create tension or pushing on the string to generate a compressive force. Alternately or in addition, the tool can be used to test the fluid port or the interval of the wellbore accessed by the fluid port, as by swab testing or pressure testing. Alternately or in addition, the tool can be used to inject fluids through the located fluid port. For example, the tool can include a fluid conduit therethrough through which fluids may be conducted and introduced adjacent the fluid port.

The apparatus and methods of the present invention can be used in various borehole conditions including open holes, cased holes, vertical holes, horizontal holes, straight holes or deviated holes.

Figure 1:
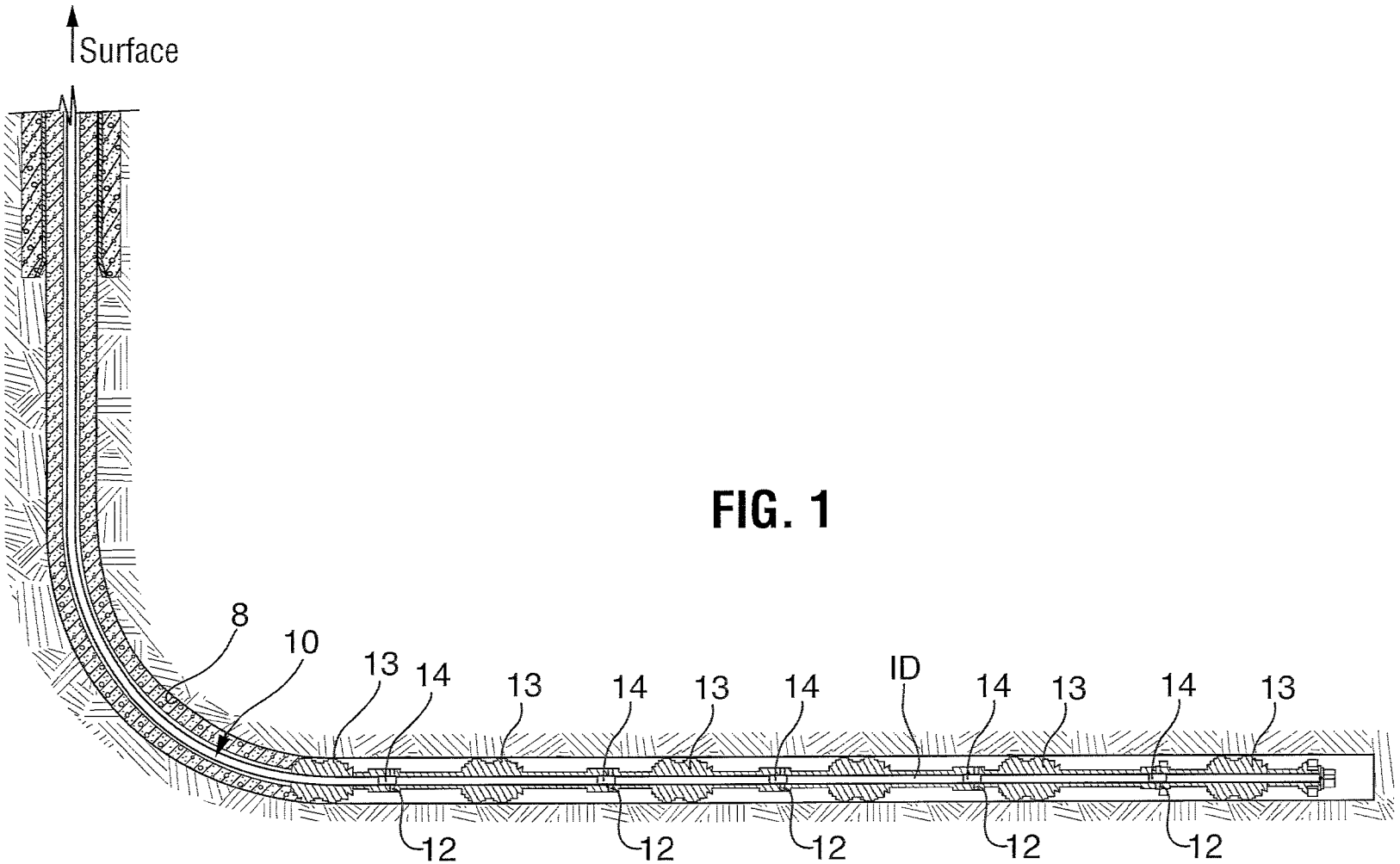
FIG. 1 is a sectional view through a tubing string positioned in a wellbore.

A tubing string may contain one or more fluid ports. FIG. 1 shows a tubing string 10 with a plurality of fluid ports 12. The tubing string may be installed in a wellbore and the fluid ports 12 permit fluidic access between the tubing string inner diameter ID and the formation through which the wellbore extends. Tubing string 10 may carry a plurality of packers 13 that can be set to create isolated intervals along the wellbore. Each interval, which is that space between adjacent pairs of packers, may be accessed through at least one port 12.

Figure 2A:
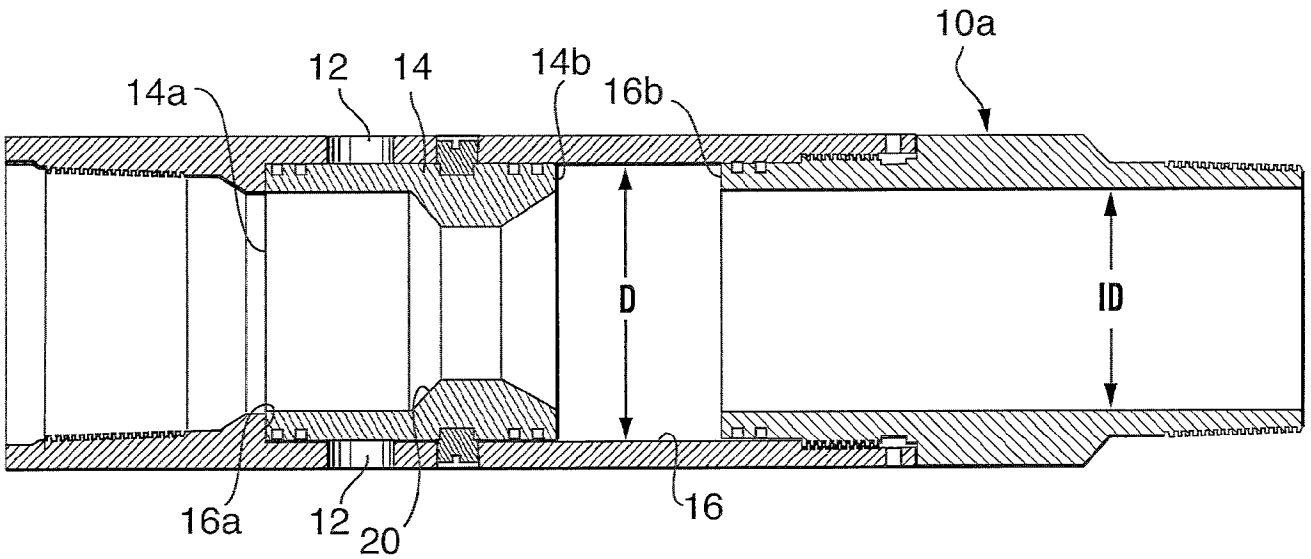
FIG. 2*a* is a sectional view through a section of a tubing string with a fluid port and a sliding sleeve and FIG. 2*b* is a sectional view through the tubing string section of FIG. 2*a* with the fluid port opened by moving the sliding sleeve.
Figure 2B:
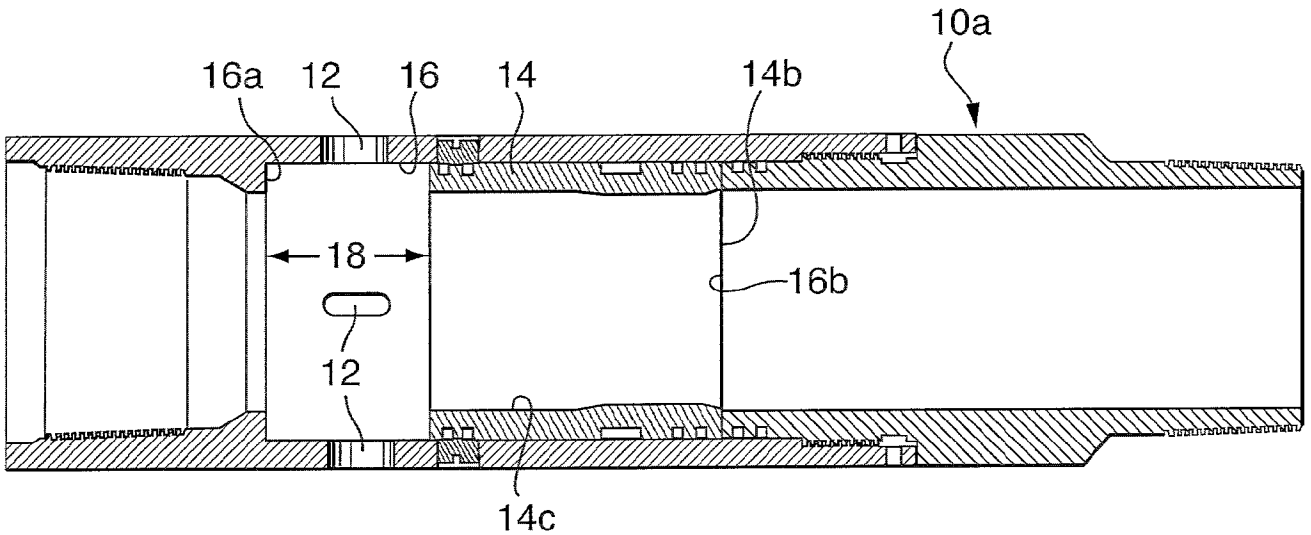

With reference also to FIGS. 2A and 2B, a tubing string fluid port is typically incorporated in a tubular sub 10*a* that can be connected into the tubing string. The tubing string fluid port of the type of interest includes a sliding sleeve 14 that acts as a valve for the fluid port is positioned in an annular recess 16 that has a diameter D greater than the inner (drift) diameter ID of string 10. In particular, sliding sleeve 14 is axially moveable along annular recess 16 to open and close fluid port 12.

Fluid port 12 is positioned in annular recess 16 and sliding sleeve 14 can move axially along the annular recess from a position covering, and therefore closing, the fluid port (FIG. 2*a*) to an open position (FIG. 2*b*), wherein sleeve 14 is retracted to some degree from the fluid port such that port 12 is opened to fluid flow therethrough. The axial position of sleeve 14 in annular recess 16 determines the open/closed condition of fluid port 12.

Annular recess 16 is defined between an upper shoulder 16*a* and a lower shoulder 16*b*. Shoulders 16*a*, 16*b* are annular steps formed in the inner wall of the tubing string wall when the inner diameter ID expands to diameter D. Annular recess 16 provides that sleeve 14 can be installed in the inner diameter of the tubing string without reducing the bore inner diameter ID. It will be appreciated that because sleeve 14 has some thickness, the ends 14*a*, 14*b* of the sleeve also define steps wherein there is a change in diameter between diameter D of the annular recess and the inner facing wall 14*c* of the sleeve. Shoulders 16*a*, 16*b* may function to stop axial movement of the sliding sleeve. For example, in the illustrated embodiment, when sleeve 14 is moved to an open position it moves down and eventually stops against lower shoulder 16*b*. The degree of movement required to move sleeve 14 from its closed position to its open position is termed the "stroke length". The length of sleeve 14 is selected with consideration of the spacing between port 12 and shoulder 16*b* to ensure that the stroke length of sleeve 14 can be accommodated. Shoulders 16*a*, 16*b* and ends 14*a*, 14*b* of the sleeve may be formed with substantially abrupt diameter changes to facilitate the interaction of the parts when they come together to positively stop the movement of the sleeve within the annular recess.

When the fluid port is exposed, and therefore open, a shift gap 18 is formed wherein an amount of annular recess 16 is exposed by movement of sleeve 14. Shift gap 18 is formed between one of the shoulders 16*a*, 16*b* of the annular recess and end 14*a* of the sleeve. The location of the shift gap depends on the direction of movement of the sleeve in the annular recess to open the port. If the sleeve moves down to open, as shown, shift gap 18 is defined between upper shoulder 16*a* and uphole end 14*a* of the sleeve. However, if the sleeve moves up to open, the shift gap may occur between the sleeve and the bottom shoulder 16*b*. When opened, port 12 is positioned in shift gap 18.

The axial length from shoulder 16*a* to the shoulder formed by end 14*a*, which is the axial length of the shift gap, can be determined by inspection of the ported sub, or the specifications therefor, to be installed in the tubing string. If the tubing string is already installed, the specifications of the ported subs used in the tubing string may be on record or available from the manufacturer.

Sleeve 14 can be moved axially along the annular recess in various ways such as, for example, by hydraulic pressures (by landing a plug on a seat to create a seal in the string, by pressuring up against an atmospheric chamber or against annular pressure, etc.), manually by engaging the sleeve and moving it or by other means. The illustrated sleeve 14 is moved by landing a ball on a ball seat 20. In the illustrated embodiment, the sliding sleeve, after movement thereof, has its ball seat removed (FIG. 2B), as by drilling out, such that constriction in the string's inner diameter caused by the ball seat is removed. In the illustrated embodiment, after the ball seat is drilled out sleeve inner wall 14*c* has a substantially consistent minimum inner diameter. Also in this embodiment, sleeve 14 is of the type without a tool landing profile and, therefore, has a substantially uniform inner diameter along its length after the ball seat is drilled out. However, some sleeves do include one or more tool landing profiles, which are annular indentations in the sleeve in which a shifting tool can land.

Figure 3:
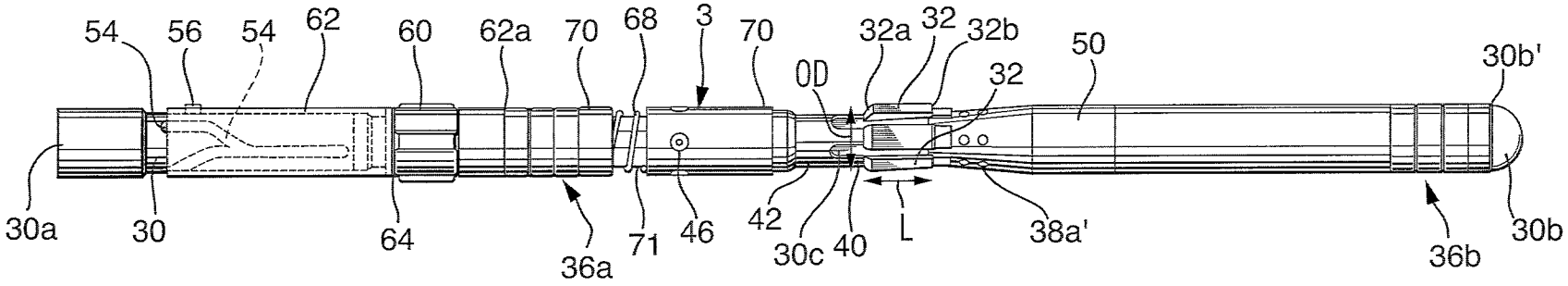
FIG. 3 is a side elevation of a port locator tool in an intermediate position.
Figure 4:
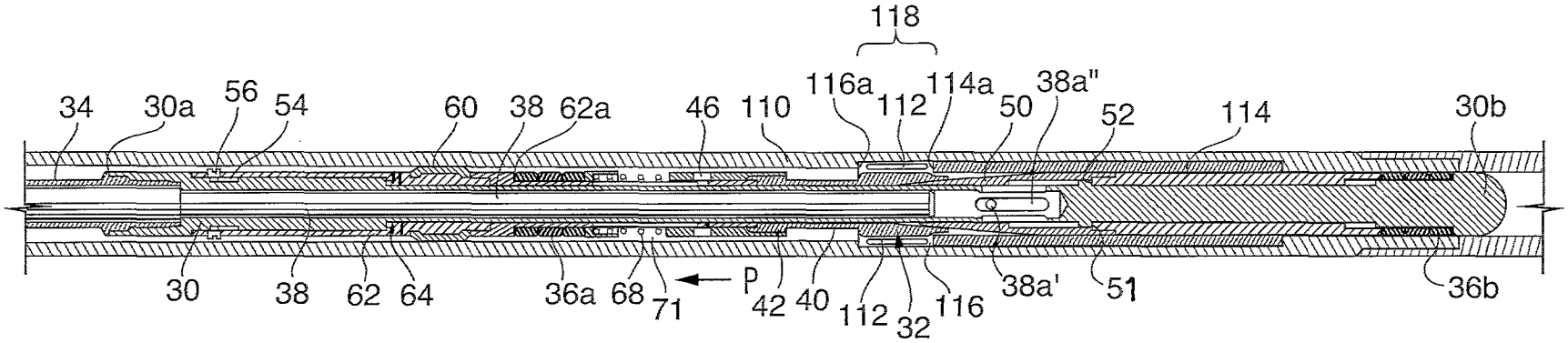
FIG. 4 is a sectional view of a port locator tool in position in a section of a tubing string in a run in hole (RIH) position with the dogs in a collapse mode.
Figure 5:
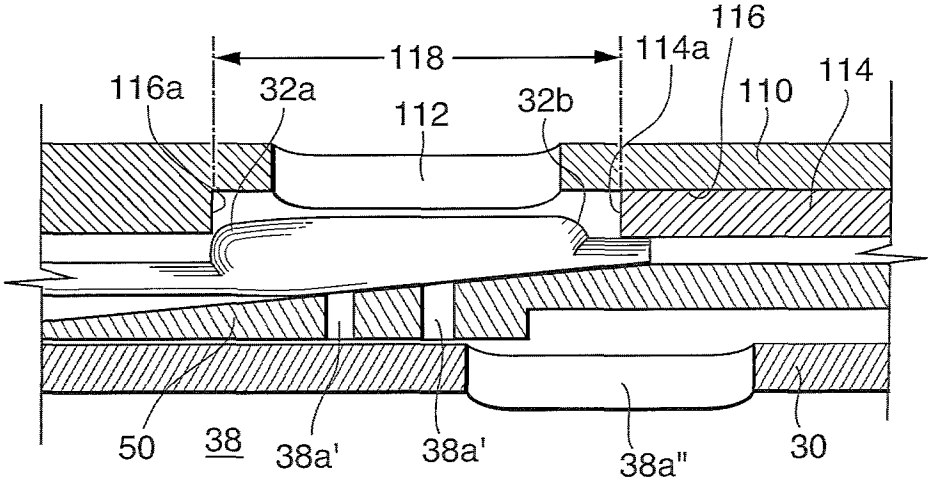
FIG. 5 is an enlarged sectional view of a locator dog in a position locating a fluid port.
Figure 6A:
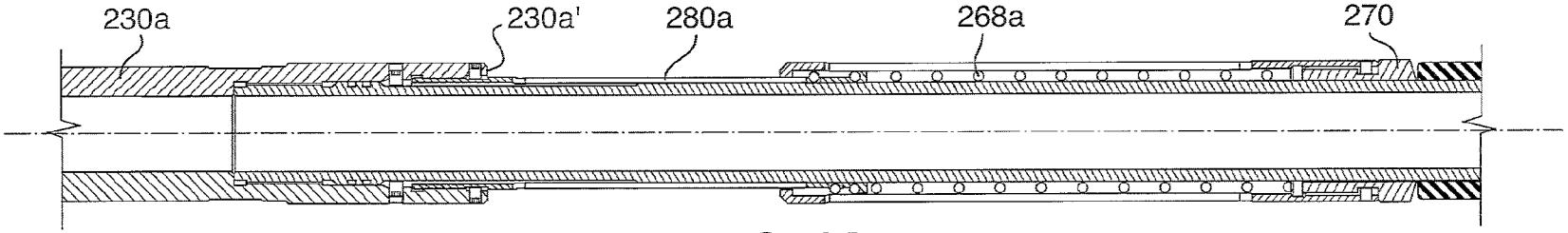
FIG. 6 are together a sectional view of a port locator tool in position in a section of a tubing string in a push down, inactive position with the dogs in a collapse mode.
Figure 6B:
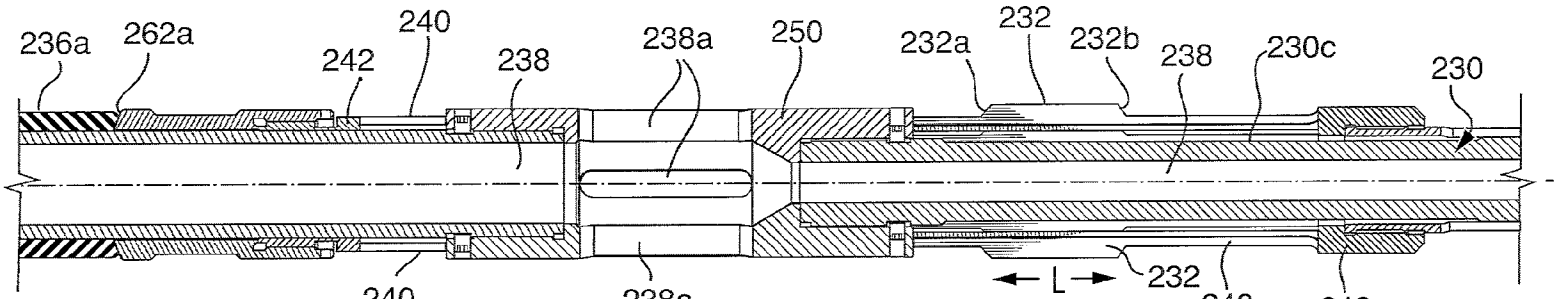
Figure 6C:
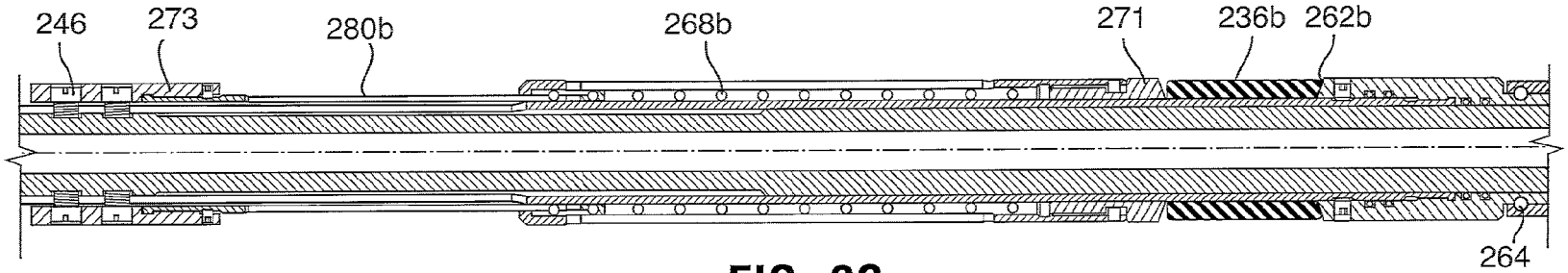
Figure 6D:
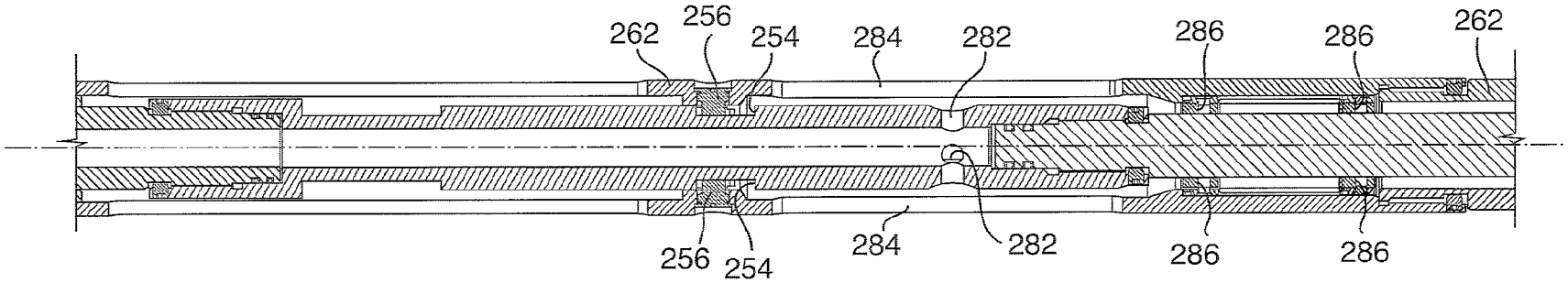
Figure 6E:
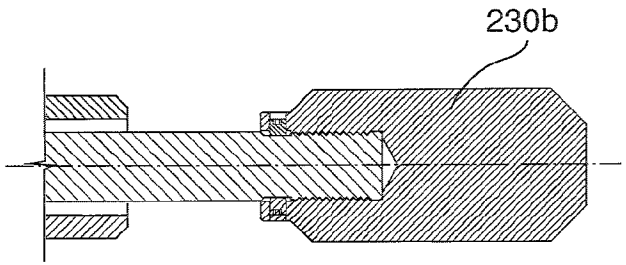

A port locator tool allows operations to locate opened fluid ports within the tubing string in the well. With reference also to FIGS. 3 to 5, the tool can locate a shift gap and has a body 3 that carries mechanically operated dogs 32. The dogs are normally inactive and capable moving through a shift gap 118 in a tubing string, but are configurable to lock into a shift gap. The dogs can be selected by sizing to lock into the shift gap, while being too large to fit into other recesses such as connections, landing profiles, etc., in the well. For example, dogs 32 can each have an upper, upwardly facing protrusion 32*a* and a lower, downwardly facing protrusion 32*b* that define an axial length L therebetween which is at least 60% or at least 80% or even at least 90% of the axial length of the shift gap. Dogs 32 can be spaced apart about the circumference of the tool body and to define, at least when locked out, an annular locking protrusion with an effective outer diameter OD that is greater than inner diameter ID of the tubular wall of the subs forming tubing string 110. For example, dogs 32 may define an effective OD between the ID of the tubing string and the diameter D of the annular recess at shift gap 18. While dogs 32 are employed in the illustrated tool, it will be appreciated that the annular locking protrusion could be provided by other structures like a c-ring, spring loaded detents, etc.

The port locator can initially locate shift gap 118 in various ways. The tool can be run in and located adjacent a shift gap based on known port locations. Alternately or in addition, the tool can have a locating protrusion that can temporarily catch on the shift gap as the shift gap is encountered by the locating protrusion. When the port locator tool temporarily catches on a shift gap, it is apparent that a fluid port is located. For example, the string is prevented from moving freely and this can be sensed by monitoring weight on work string 34 to which the tool is attached. Dogs 32 can be selected to act as the protrusions, catching in each shift gap encountered. Alternately, as shown, other protrusions, such as drag blocks 60 can be provided to catch on and initially locate the shift gaps. While dogs 32 could be employed to catch in the shift gaps, if there is a concern that the dogs may be damaged by riding along the string or catching in the shift gaps, other protrusions may be employed. If other protrusions are employed, they can also if desired be selected by sizing to noticeably catch in only the shift gaps, for example, being too large to fit into other recesses in the well. For example, the protrusions can each have an axial length which is at least 60% or at least 80% or even at least 90% of the axial length of the shift gap. In use when running down into tubing string 110, the protrusions may be biased out to ride along the string wall. They may have a normal outer diameter just greater than the ID of the string and be compressed to fit in the tubing string. The protrusions can be spaced apart about the circumference of the tool body to define an annular protrusion with an effective outer diameter OD that is greater than inner diameter ID of the tubular wall of the subs forming tubing string 110.

The protrusions are free to rapidly collapse and move through the shift gaps, but do catch at least briefly in the shift gaps when located axially thereover. This brief catching action provides the indication at surface that a shift gap has been located.

After a shift gap, and therefore a fluid port, is located, one or more wellbore operations may be conducted. First, dogs 32 are positioned in the located shift gap 118. If the dogs were used to locate the shift gap they may already be in the shift gap. If the shift gap was located in another way, the tool may have to be moved to locate dogs 32 in the located shift gap. Then dogs 32 may be locked into the shift gap.

The tool can be provided with a setting mechanism for locking dogs 32 into a shift gap. The setting mechanism allows dogs 32 to alternate between a collapse mode and a locked out mode. In the collapse mode, the dogs are either collapsed or collapsible such that they do not lock into a shift gap. They either are collapsed so that they don't catch on the shift gap as they pass or they are collapsible to briefly catch in the shift gap, but can readily thereafter pass thereout. For example, after locking out into a shift gap, dogs 32 must again be collapsed or collapsible to allow the tool to move out of the shift gap and out of the tubing string or to another port. In the locked out mode, the dogs, when they expand into the shift gap are locked therein until the setting mechanism releases the lock condition.

Various setting mechanisms are possible. For example, the mechanism may respond to a predetermined snap force such that once a certain pull force is applied to body 30, dogs 32 will snap through the shift gap. Alternately, the mechanism may be hydraulic such that when fluid is pumped to the tool, the dogs expand or retract, as desired. Alternately, the mechanism could respond to a mechanical manipulation such as axial movement (i.e. pulling the string into tension to pull on the tool or putting weight into the string to push down on the tool) or rotation (i.e. turns to the right could be used to have the dogs retract such that they can be pulled through to the next port gap and then rotation could be used again to get the dogs to activate and locate further shift gaps.) The mechanism, in any event, operates to permit the dogs to be collapsed or collapsible to move through the tubing string, and then to releasably lock into a shift gap and, thereafter, become collapsed or collapsible again to be moved out of the shift gap when it is desired to continue movement of the tool through the tubing string. The mechanism is typically controlled by string manipulation or pump pressure on surface so that the dogs can be positively and securely locked into the shift gap and be operated repeatedly relative to a plurality of gaps without needing to trip to surface.

The mechanism could operate with a control mechanism such as an indexing j-keyway for moving the tool between the collapse mode and the locked out mode. For example, a control mechanism can be employed to control the operation of dogs 32 to locate and/or lock into fluid ports depending on the intended running direction of the tool. The dogs may be maintained in a collapse mode (i.e. collapsed or collapsible) to move through the shift gaps, but then when the tool is pulled back up (arrow P) toward surface, dogs 32 are positionable in the shift gaps and, in particular, releasably lock into these gaps when the dogs are located axially thereover. In this illustrated embodiment, the tool dogs are selected to be in the collapse mode and move readily through the shift gaps on the way in, but when the tool is being pulled out of the string dogs 32 are controlled between the collapse mode and a lock out mode, when they can locate and lock into each shift gap/fluid port that the dogs move through.

With the tool engaged in the shift gap, the tool may be employed to isolate the fluid port from the rest of the tubing string inner diameter. In one embodiment, there may be one or more annular seals 36*a*, 36*b* (referred to collectively as seals 36) on one or both ends of tool body 3 that are settable to expand radially outwardly from the tool body and to seal against the inner wall of the tubing string in which the tool is located. Seals 36 can be located relative to the dogs to either seal directly adjacent the fluid port (in the annular recess, on the sliding sleeve valve, etc.) if that's conducive, or possibly against the tubular wall nearby but offset from the fluid port 112, sleeve 114 and annular recess 116.

Tool body 3 may alternately or in addition have a fluid conduit 38 extending therethrough from an upper end 30*a* to an opening 38*a*' (opening 38*a*' in the illustrated embodiment is actually a combination of two openings 38*a*', 38*a*" described hereinafter) such that fluids can be conveyed through the tool body, for example, to convey fluids to or from the surface operations at the wellhead through work string 34 connected to upper end 30*a*.

A tool with seals 36 on both ends and opening 38*a*' between the seals may be useful for various operations relevant to fluid port 112 located by dogs 32. Seals 36 may be set to seal off a section of the tubing string inner diameter around the port, while fluid communication is available with the isolated area between the seals though conduit 38 and opening 38*a*', and various procedures can be undertaken. For example, the tool can be used to ensure that the dogs are in fact locked into a shift gap, since the conductivity to the formation can be confirmed through conduit 38. Also, in a case where the operator is uncertain through which port the production fluids are entering the tubing string, a swab test can be conducted to collect produced fluids from only a located and isolated port 112. The tool may also be useful for fluid treatment of the formation accessed through the located port. Such fluid treatments may include restimulation, cleanup jobs, fracs, sand fracs, and the like. In such fluid treatment operations, fluids can be injected directly from the tool through the located and isolated port 112.

In a tubing string with multiple fluid ports, this tool/method permits each port and the interval of the formation accessed therethrough to be individually tested. In one embodiment, once a port is isolated, it is swab tested. If the test determines that no useful fluids are being produced through that port then, optionally, the tool through its string 34 could be hooked up to a pumper for example a frac unit and treatment fluids can be pumped in to restimulate the interval of the well accessed through the located fluid port. This may render the interval more productive than it was previously. In another embodiment, testing may indicate that the interval has undesirable production such as water or gas, while production of oil is of interest, and that port could be closed off by closing the sleeve, installing a patch such as a straddle packer, etc. In another embodiment, the tool may be employed to practice secondary or tertiary recovery through the located port.

In summary, therefore, the port locator tool is selected to locate a fluid port by locating the shift gap in which the fluid port is located. Once the tool is located near a port, dogs 32 are shaped and sized to snap into only the shift gap. The tool will locate each shift gap into which the dogs are shaped to fit, while the dogs are unable to fit into other tubing inconsistencies (i.e. connections, landing profiles, etc.). As such, measurements aren't needed concerning the location of each port and specific profiles need not be introduced to the tubing string. Furthermore, if a string is encountered in which the locations of the ports are not know and/or the port sleeves or surrounding bodies do not have any landing profiles, the current tool/method can be employed to locate the fluid ports. If the tool carries seals 36, the seals can pack off above and/or below the located port to pressure isolate the port. If the tool includes fluid conduit 38, fluid tests can be conducted about the located fluid port and/or fluids can be introduced to treat the interval accessed through the located fluid port.

By use of the tool, therefore, fluid ports in a tubing string can be located and, if desired, tested to determine the quality and/or quantity of production. Ports with undesirable production can be shut off, or treatments can be effected therethrough to enhance production. Treatments can include stimulation (fracing), acidizing, or cleaning. Alternately, the tool may be employed to practice secondary and tertiary recovery, which includes injecting water for water flood applications, or injecting gas, such as, for example, natural gas or $CO_2$, to flood and push production to other adjoining wells. Thus, the tool may be used as an enhanced oil recovery (EOR) tool.

With closer reference to the specifics of the tool of FIGS. 3 to 5, the tool operates to locate a fluid port by locating shift gap 118 in which fluid port 112 is located. In the illustrated embodiment, the tool body 3 includes an inner mandrel 30 including an upper end 30*a*, a lower end 30*b* and an outer surface 30*c* extending between the ends.

The tool carries drag blocks 60 that are biased radially outwardly from the body and have a normal OD greater than the tubing ID such that when in the string, the drag blocks drag along the tubing string inner wall. Drag blocks 60 expand into the shift gap as soon as they are aligned over the shift gap. When the tool is moved along the tubing string, drag blocks 60 may catch on and be unable to easily pass shoulder 116*a* and end 114*a* of the sleeve. When this occurs, the drag blocks, being connected to the mandrel, interrupt movement of the tool through the string. This resistance to continued movement of the tool can be sensed at surface by monitoring tension in string 34 on which the tool is carried. When resistance is sensed at surface, this indicates that the tool's drag blocks are located in a shift gap and, therefore, the tool is positioned at a fluid port.

A plurality of dogs 32 are also carried on and spaced apart about a circumference of mandrel 30. Dogs 32 can move axially over mandrel 30 within a limited range but remain connected to the mandrel. The plurality of dogs 32 in this embodiment are radially biased inwardly against the body in the collapse mode, but are configurable between that collapse mode and an outwardly locked mode where they are urged radially out to an effective outer diameter OD greater than ID. Dogs 32 may each be substantially uniform. Dogs 32 encircle the mandrel's outer diameter to effectively create an annular protrusion on the tool. The dogs can act together to locate in shift gap 118. When the dogs are moved into axial alignment with a shift gap, they can be expanded out into the shift gap and can catch in that recess if they cannot collapse inwardly. The tool includes a setting mechanism to move the dogs between the outwardly locked mode and the collapse mode.

The plurality of dogs can be spaced apart about the circumference such that open spaces remain between adjacent dogs through which fluid can flow past the dogs, between mandrel 30 and the tubing string inner diameter.

The shape of each dog can be selected to fit only in the fluid port gap, such that they cannot be expanded into something other than shift gap 118. For example the length of the outwardly facing surface between protrusions 32*a*, 32*b* may be selected to be slightly less than the length of the shift gap between its upper shoulder 116*a* and its lower shoulder 114*a*. For example, as noted above, the length L between protrusions 32*a*, 32*b* may be at least 60% of the axial length of the shift gap into which the dog is intended to locate. However, to avoid any false landing of the dogs, the length L could be at least 90% of the shift gap's axial length.

When a dog is expanded into the shift gap its upper protrusion 32*a* and its lower protrusion 32*b* both extend into the shift gap with (i) protrusion 32*a* positioned to butt against shoulder 116*a* if the tool is moved up and (ii) protrusion 32*b* positioned to butt against sleeve end 114*a* if the tool is moved down. To exit the shift gap, the leading protrusion, 32*a* or 32*b* depending on the direction of travel, must ride up over the shoulder or end of sleeve 114. The protrusions can each be shaped to catch on the shoulders of the shift gap, but to have a rounded or tapered profile to permit the dogs to ride out past the shoulders when they are capable of collapsing. The surface between the protrusions can be concave or can be filled in, as shown. The surfaces of dogs 32 are generally smooth such that they readily ride along, rather than grip, the inner wall surface of the tubing string.

While other constructions are possible, in the illustrated embodiment, the dogs are formed as the fingers of a one-piece collet-style collar. Dogs 32 are formed on fingers 40 that extend from a collar 42. The inward bias in dogs 32 may be achieved through a spring effect created through fingers 40. Collet construction ensures that the dogs work in unison and about a circumference of the tool. Collet may have fingers anchored on one end, as shown, or both ends.

Dogs 32 fit in the shift gap and can releasably lock into the shift gap. It is to be noted, however, that if the tool is in the collapse mode or enough force is applied, an emergency over-pull release, for example through the shearing of pins 46, may allow release of the tool setting mechanism, allowing the dogs to move past the discontinuities including past a shift gap, such that the risk of the tool becoming stuck in the string is reduced.

The setting mechanism moves the dogs between the outwardly locked mode and the collapse mode. In one embodiment, the setting mechanism operates in response to forces applied to the tool. For example, the setting mechanism can be responsive to compressive force or force in tension acting on the tool, applied by manipulation of the string to which the tool is attached. In one embodiment, for example, the setting mechanism includes a backup insert 50 that is positioned behind the dogs when they are outwardly locked and axially offset from behind the dogs when they are in the collapse mode. Backup insert 50 may, for example, have a conical form and may be axially moveable relative to the dogs to be drivable under the dogs to urge them out into shift gap 118. In the illustrated embodiment, backup insert 50 is a sleeve carried on mandrel 30 and is axially drivable by the mandrel relative to dogs 32. Backup insert 50 is also axially moveable over mandrel 30 but is limited by abutment of shoulder 51 on mandrel 30 with shoulder 52 on insert 50 and by abutment against seals 36*b*.

In this illustrated embodiment, setting mechanism includes a control mechanism to control operations of setting mechanism. The control mechanism may control movement of the tool between the outwardly locked mode and the collapse mode, wherein the setting mechanism can only set when permitted to do so by the control mechanism. One suitable control mechanism may include for example a J-keyway, such as may include a J-slot 54 and a key 56 that rides in the J-slot. In the illustrated embodiment, J-slot 54 is continuous, sometimes termed a walking J-slot, extending about the circumference of the tool, such that the tool can be repeatedly controlled between the locked out and collapse modes by moving the tool axially up and down. Drag blocks 60 may be employed to create relative motion between a drag housing 62 and mandrel 30, which is manipulated through movement of string 34. This relative motion permits actuation of key 56 through the J-slot 54.

To better understand the operation of the illustrated tool, it is noted that drag housing 62 includes a swivel 64 between J-key 56 and drag blocks 60 such that the section of drag housing carrying key 56 can rotate about the mandrel as driven by the J-key's interactions in J-slot 54, but that interaction of pin 56 in slot 54 allows axial movement of the mandrel to be sometimes isolated from the drag housing, except when the key pushes against an end stop of the J-slot. Collar 40, from which dogs 32 extend, is connected to drag housing 62 and moves axially therewith. Axial movement of mandrel 30, therefore, also is isolated from dogs 32 except as permitted by the J-slot.

The J-keyway permits the tool to move through three axial configurations: (i) a run in hole (RIH) position, (ii) a pull up, inactive position and (iii) a pull up, active position. In operation, the three relative axial positions determine the location of back up insert 50 relative to dogs 32, wherein (i) in the run in hole the relative axial position spaces dogs 32 away from the back up insert 50, (ii) in the pull up, inactive position, dogs 32 and back up insert 50 are held apart such that the back up insert 50 cannot move under the dogs 32 although the resistance in drag blocks would urge dogs 32 towards the back up insert and (iii) in the pull up active position, back up insert 50 is allowed to move under the dogs 32. The J-keyway has a layout to allow the pin to move through four positions embodying the three axial positions. In particular, the J-slot includes (1) a stop where the drag housing and dogs are positioned in a run in hole (RIH) position, followed by (2) a stop where the drag housing and dogs are positioned in a pull up, inactive position, followed by (3) a stop where the drag housing and dogs are positioned in a run in hole (RIH) position and finally followed by (4) a stop where the drag housing and dogs are positioned in a pull up, active position. Since J-slot 54 is continuous, the slot opens from stop (4) to stop (1). Movement of the key from stop to stop is by axial movement of mandrel 30 while drag housing 62 is held stationary by engagement of drag blocks 60 against the inner wall of the wellbore. When moving from the pull up, active position to the run in hole position, back up insert 50 is moved out from under the dogs by abutment of shoulder 52 against shoulder 51.

The tool of FIGS. 3 to 5 operates to locate a fluid port in the tubing string in which the tool is operated and may further serve to permit pressure isolation of the fluid port and/or fluid delivery thereto. For example, as noted above, the illustrated tool includes annular seals 36*a*, 36*b* that straddle dogs 32. Annular seals 36 are provided on both sides (above and below) of dogs 32 such that when the seals are expanded, the area of the tool at the dogs, which will be that area positioned at shift gap 118 and therefore at fluid ports 112, can be isolated from the remainder of the tubing string inner diameter both above and below. The annular seals may be always expanded (cup style) or may be settable/releasable. Generally, it is more useful to have settable/releasable seals because flow is only restricted when it is desirable to do so and the seals can be retracted when moving from port to port. Also, while a cup style seal operates in one direction only, a settable/releasable annular seal can be bi-directional, able to hold pressure against pressure differentials in either direction. Annular seals 36 in the illustrated embodiment, are settable/releasable. Seals 36 are annular members formed of extrudable, resilient material such as may be based on rubber and seals 36 are each able to be expanded into a set position by compression between compression surfaces, herein shown as a shoulder 62*a* of drag housing 62, a sleeve 70, back up insert 50 and shoulder 30*b*' of the end of the mandrel. Seals 36 are retractable by moving the compression surfaces 62*a*/70 and 50/30*b*' away from each other to remove the compressive force from the seals.

In the illustrated embodiment, annular seals 36 may be set in response to forces applied to the tool. While fluid pressure may be employed for seal packing, the illustrated seals may be set in response to compressive force or force in tension, applied by manipulation of the string 34 to which the tool is attached. For example, as shown, pull tension could be applied to pack off the seals, wherein the compression surfaces are drawn together in response to pull tension placed on the tool, which in turn compresses and expand the seals. For example, seals 36 may be set wherein after locking into a shift gap, the string can be pulled up and into tension and to pull the tool into tension to drive the seals to expand and pack off between the tool and the tubing string. Alternately, the annular seals may be set with compression, wherein after running in, pulling up and snapping into a gap, weight could be slacked off the tool to get the seals to expand and pack off between the tool and the tubing string.

A control mechanism may be provided to control setting and unsetting of the seals 36. A suitable control mechanism may include for example a J-slot and in this embodiment, the J-slot including J-slot 54 and J-key 56 are also employed to control setting of the seals. In the run in hole and pull up, inactive positions, the packers are maintained in an unsettable position, wherein in the pull up, active position, the packers can be compressed and set.

It is noted that the lower seal 36*b* sets when mandrel 30 is pulled up with back up insert 50 held stationary: wedged beneath dogs 32. This compresses seals 36*b* between back up insert 50 and shoulder 30*b*'. Upper seal 36*a* sets when sleeve 70 is moved by mandrel 30 towards shoulder 62*a* on drag housing. In particular, sleeve 70 is connected by pin 46 to mandrel 30. When mandrel 30 is pulled up (by pulling tension into string 34), mandrel 30 pulls sleeve against seals 36*a*, while drag housing 62 is maintained stationary by dogs 32 locked into shift gap 118. In this embodiment, sleeve 70 includes two parts spaced at a gap 71 and biased apart by a biasing means such as a spring 68. Spring 68 ensures that seals 36*a* are normally held in a fixed position and gap 71 allow seals 36*a* to begin to set only after dogs 32 are locked out. As such, the timing of the tool operations can be selected. First, dogs 32 can be locked into shift gap 118 and then the seals 36 can be set. Also, the tool can be selected such that both seals 36*a*, 36*b* set substantially simultaneously. This more or less simultaneous setting can be achieved by selection of the size of gap 71 in sleeve 70 such that the sleeve will only be capable of applying force on the seals when the gap is closed.

The tool may be sized and/or the seals positioned such that they are any distance from dogs 32. In one embodiment, the seals straddle and are spaced from the dogs with consideration of the construction and size of the fluid port such that when the dogs are located in shift gap 118, the seals are positioned to seal against a continuous surface such as along the wall of a tubular of the string rather than directly against the sliding sleeve valve. The seals may include a rating sufficient to withstand pressures associated with wellbore treatments such as greater than 2500 psi.

Also in the illustrated embodiment and as noted above, the tool may include fluid delivery openings 38*a*' such that fluid may be delivered to fluid port 112 located by dogs 32. Fluid delivery openings 38*a*' are positioned between seals 36 and adjacent dogs 32. As noted above, the tool body includes conduit 38, which is an inner bore through mandrel 30 and is accessed through an opening at upper end 30*a*. Fluid can be delivered to the conduit provided through the inner bore through the open end and the fluid passes out of the bore through fluid delivery openings 38*a* to the area of the tool adjacent the dogs, which will be that area positioned at the fluid ports. By placing the fluid delivery ports adjacent and possibly substantially directly below dogs 32, any fluid passing through openings 38*a*' can flow directly radially out toward located ports 112. As noted above, openings 38*a*' are actually a combination of openings 38*a*' and 38*a*". Openings 38*a*' extend through back up insert 50 and openings 38*a*" extend through the wall of the mandrel. Thus, fluid passing out of the tool must pass through conduit 38, through openings 38*a*" and then out through openings 38*a*'.

The well bore in which the tool is positioned may be closed or closeable by upper annular seal 36*a* and lower annular seal 36*b* such that pressure isolation can be maintained at the dogs, when the seals are set. Fluid conveyed to the tool, therefore, exists in the isolated zone between the seals. String 34 can be a tubular string, such as coiled tubing or small diameter connected tubulars, so that fluid can be conveyed through the string to the inner bore of the tool.

The tool may include pressure gauges and/or recorders adjacent the dogs to permit determination of dynamic downhole pressure numbers, measurements, etc. so that the pressure of each interval accessed through the port may be obtained.

In view of the foregoing there is provided a method for locating a fluid port in a tubing string, the fluid port being positioned in a shift gap which is an annular recess from the inner diameter of a tubing string, the method comprising: running a string with a tool thereon into a wellbore tubing string, the tool including a tool body and a plurality of dogs spaced apart about a circumference of the body, the dogs being configurable between an outwardly locked mode and a collapse mode; and moving the tool through the tubing string until the dogs anchor in the shift gap.

The tool could be anchored into the shift gap on the way in hole or while pulling out. In one embodiment, the tool is run to a position below (downhole of) the lowermost fluid port of interest for example, it can be run all the way to bottom or its depth can be compared with known depths for the lowermost fluid port. Generally, the location of any fluid port is known at least within a range and the depth of a string during run in can be determined by known methods.

The method can further include setting seals 36*a*, 36*b* to create an annular seal about the tool above and/or below the dogs. The seals can set after the dogs lock into a shift gap and can be set at about the same time. The method can include isolating the fluid port, testing the fluid port or through the fluid port, and/or injecting fluids from the tool through the fluid port. The method can further include pumping fluid out through the tool adjacent the dogs and, for example, may include pumping fluid out through the tool and directly radially out from below the dogs toward the located fluid port in the tubing string.

In one embodiment, a method includes:

1. Running the tool on a work string, the tool being in the run in hole (RIH) position (FIG. 4);
2. Running the dogs of the tool down past the shift gap in which the fluid port is positioned, the drag blocks collapsing to pass the shift gap on the way down and thus providing an indication of the location of the shift gap;
3. Pull up on the string to activate the tool for dog engagement, as controlled by the J-keyway;
4. Continued upward movement locates the dogs in the fluid port shift gap;
5. Once the dogs snap into the shift gap, they are locked therein by the conical back up insert moving behind them;
6. With the dogs locked into the shift gap, pull tension into the tool to set the seals;
7. Leave the tool in tension during further operations to maintain the seals set;
8. Set down weight to release the tool and the tool will move automatically via the J-keyway to the RIH position with the dogs in the collapse mode and the seals retracted;
9. Pull up to put the tool in an inactive, in tension position in the key way with the dogs in a collapse mode and the seals retracted so it can pass through the shift gap and be pulled up towards the next fluid port;
10. After the dogs are pulled uphole of the shift gap, initiate downward movement followed by upward movement to reactivate the tool for dog engagement. This may be done immediately after the dogs are pulled uphole of the shift gap, once the tool is moved further up hole or after a next shift gap is sensed; and
11. Repeat from step 4 for further shift gaps.

Further operations may include testing at the port, fluid injection at the port, etc.

In one method according to the present invention, the fluid treatment is borehole stimulation using stimulation fluids such as one or more of acid, gelled acid, gelled water, gelled oil, $CO_2$, nitrogen and any of these fluids containing proppants, such as for example, sand or bauxite.

While the tool of FIGS. 3 to 5 sets in tension, it has been noted above that a port location tool could alternately be set in compression. A compression set tool is illustrated in FIG. 6. The compression set tool operates in generally a similar way to that tool described in detail above. In the illustrated embodiment, the tool body includes an inner mandrel 230 including an upper end 230*a*, a lower end 230*b* and an outer surface 230*c* extending between the ends. A plurality of dogs 232 are carried on and spaced apart about a circumference of mandrel 230. Dogs 232 can move axially over mandrel 230 within a limited range but remain connected to the mandrel. The plurality of dogs 232 are radially biased outwardly from the body, but are configurable between an outwardly locked mode and a collapse mode. The tool includes a setting mechanism to move the dogs between the outwardly locked mode and the collapse mode.

Dogs 232 may each be substantially uniform. Dogs 232 encircle the mandrel's outer diameter to effectively create an annular protrusion on the tool. The dogs can act together to locate in a shift gap. When the dogs are moved into axial alignment with a shift gap, they expand out into the shift gap and can catch in that recess if they cannot collapse inwardly. When in the outwardly locked mode and when moving along the shift gap, the protrusions 232*a*, 232*b* on the outwardly facing surface of the dogs may catch on and be unable to easily pass the shoulder and the end of the sleeve. This stops the dogs from exiting the shift gap, and the dogs being connected to the mandrel, movement of the tool through the string is interrupted. This resistance to continued movement of the tool can be sensed at surface by monitoring tension in the string to which the upper end of the mandrel is connected. When resistance is sensed at surface, this indicates that the tool's dogs are located in the shift gap and, therefore, are positioned at a fluid port.

Dogs 232 may be biased outwardly from mandrel 230 and have a normal effective outer diameter greater than ID such that the dogs ride along the tubing string inner wall and expand into the shift gap as soon as protrusions 232*a*, 232*b* both are aligned over the gap.

The plurality of dogs can be spaced apart about the circumference such that open spaces remain between adjacent dogs through which fluid can flow past the dogs, between mandrel 230 and the tubing string inner diameter.

The shape of each dog can be selected to fit only in the fluid port gap, such that they don't expand into something other than a shift gap. For example the length of the outwardly facing surface between protrusions 232*a*, 232*b* may be selected to be slightly less than the length of the shift gap between its upper shoulder and its lower shoulder. For example, as noted above, the length L between protrusions 232*a*, 232*b* may be at least 60% of the axial length of the shift gap into which the dog is intended to locate. However, to avoid any false landing of the dogs, the length L could be at least 90% of the shift gap's axial length.

When a dog expands into the shift gap its upper protrusion 232*a* and its lower protrusion 232*b* both extend into the shift gap with (i) protrusion 232*a* positioned to butt against the upper shoulder of the shift gap if the tool is moved up and (ii) protrusion 232*b* positioned to butt against the lower shoulder of the shift gap if the tool is moved down. To exit the shift gap, the leading protrusion, 232*a* or 232*b* depending on the direction of travel, must ride up over the shoulder or the end of the sleeve. The protrusions can each be shaped to catch on the shoulders of the shift gap, but to have a rounded or tapered profile to permit the dogs to ride out past the shoulders when they are capable of collapsing. The surface between the protrusions can be concave or can be filled in, as shown. While providing some resistance to movement along the tubing string inner wall for its drag effect, the outer facing surface of dogs is generally smooth and devoid of teeth such that the surface does not bite into the inner wall surface of the tubing string.

While other constructions are possible, in the illustrated embodiment, the dogs are formed as the fingers of a one-piece collet. Dogs 232 are formed on fingers 240 that extend between collars 242. The outward bias in dogs 232 may be achieved through a spring effect created through fingers 240. Collet construction ensures that the dogs work in unison and about a circumference of the tool.

Dogs 232 fit in the shift gap and can releasably lock into the shift gap. It is to be noted, however, that if the tool is in the collapse mode or enough force is applied, the dogs can be sheared out of any set position to move past the discontinuities including past a shift gap, such that the risk of the tool becoming stuck in the string is reduced.

The setting mechanism moves the dogs between the outwardly locked mode and the collapse mode. In one embodiment, the setting mechanism operates in response to forces applied to the tool. For example, the setting mechanism is responsive to a compressive force on the tool, applied by manipulation of the string to which the tool is attached. In one embodiment, for example, the setting mechanism includes a backup insert 250 that is in a position behind the dogs when they are outwardly locked and is axially offset from behind the dogs when they are in the collapse mode. Backup insert 250 may, for example, have a cylindrical form and may be axially moveable relative to the dogs to be drivable under the dogs when they are radially biased out into a shift gap. In the illustrated embodiment, backup insert 250 is an enlargement on mandrel 230 and moves with the mandrel relative to dogs 232. Backup insert 250 includes axial grooves on its outer surface through which the fingers extend.

In this illustrated embodiment, the setting mechanism includes a control mechanism to control operations of setting mechanism. The control mechanism may control movement of the tool between the outwardly locked mode and the collapse mode, wherein the setting mechanism can only set when permitted to do so by the control mechanism. One suitable control mechanism may include for example a J-keyway, such as may include a J-slot 254 and a key 256 that rides in the J-slot. In the illustrated embodiment, J-slot 254 is continuous, sometimes termed a walking J-slot, extending about the circumference of the tool, such that the tool can be repeatedly controlled between locked and collapse modes by moving the tool axially up and down. The J-keyway allows limits axial movement of the mandrel relative to a drag housing 262 on which the keys are mounted. The dogs 232 act to create drag resistance for drag housing 262 that allows the key to move through the slot.

To better understand the operation of the illustrated tool, it is noted that drag housing 262 includes a swivel 264 between J-key 256 and drag blocks 260 such that the section of drag housing carrying key 256 can rotate about the mandrel as driven by the J-key's interactions in J-slot 254, but that interaction of key 256 in slot 254 allows the mandrel to move within the drag housing. Collars 242, from which dogs 232 extend, are connected to drag housing 262 and moves axially therewith. Axial movement of mandrel 230, therefore, also is separated from dogs 232 except as permitted by the J-slot.

J-keyway permits the tool to move through three axial configurations: (i) a pull up inactive position, (ii) a push down, inactive position and (iii) a push down, active position. In operation, the three relative axial positions determine the location of back up insert 250 relative to dogs 232, wherein (i) in the pull up hole the relative axial position spaces dogs 232 away from the back up insert 250, (ii) in the push down, inactive position, dogs 232 and back up insert 250 are held apart such that the backup insert 250 cannot move under the dogs 232 although the resistance in dogs would normally urge dogs 232 towards the back up insert and (iii) in the push down active position, back up insert 250 is allowed to move under the dogs 232. The J-keyway has a layout to allow the pin to move through four positions embodying the three axial positions. Movement of the key through the J-slot is by axial movement of mandrel 230 while drag housing 262 is held stationary by engagement of dogs 232 against the inner wall of the wellbore.

The tool of FIG. 6 operates to locate a fluid port in the tubing string in which the tool is operated and to permit pressure isolation of the fluid port and/or fluid delivery thereto. For example, as noted above, the illustrated tool includes an annular seal 236*a* positioned between dogs 232 and upper end 230*a* and another annular seal 236*b* between lower end 230*b* and dogs 232. When seals 236*a*, 236*b* are expanded, the area of the tool at the dogs, which will be that area positioned at the shift gap and at the opened fluid ports, can be isolated from the remainder of the tubing string inner diameter both above and below. The annular seals are settable/releasable and formed of extrudable, resilient material such as may be based on rubber. Seals 236 are each able to be expanded into a set position by compression between compression surfaces, herein shown as a shoulder 262*a* of drag housing and a sleeve 270 for seal 236*a* and for seal 236*b*: a shoulder 262*b* of drag housing and a sleeve 271 on the upper end of the mandrel. Seals 236 are retractable by moving the compression surfaces 262*a*/270 and 262*b*/271 away from each other to remove the compressive force from the seals.

In the illustrated embodiment, annular seals 236 may be set in response to compressive forces applied to the tool by manipulation of the string to which the tool is attached. For example, as shown, compression could be applied to pack off the seals, wherein the compression surfaces are pushed together in response to weight placed on the tool. For example, seals 236 may be set wherein after locking into a shift gap, weight can be set down to compress the tool and drive the seals to expand and pack off between the tool and the tubing string.

The J-keyway also acts as a control mechanism to control setting and unsetting of the seals 236. In the pull up and the push down, inactive positions, the packers are maintained in an unsettable position and in the push down, active position, the seals can be compressed and set.

It is noted that the seals set after back up insert 250 is in position beneath dogs 232. The seals 236 set at about the same time. Once in that position, drag housing 262, which is connected to dogs 232, cannot move and movement of the mandrel compresses seal 236*a* between shoulder 262*a* of drag housing and sleeve 270 as it is moved by the mandrel and compresses seal 236*b* between shoulder 262*b* of drag housing and sleeve 271 as moved by mandrel 230. In particular, sleeve 270 rides above seal 236*a* and is driven by shoulder 230*a*' when mandrel is pushed down. Sleeve 271 is driven by a collar 273 that is connected by a pin 246 to mandrel 230. When mandrel 230 is pushed down while drag housing is locked against moving, mandrel 230 pushes collar 273 which eventually contacts sleeve 271 and pushes it against seals 236*b*, which causes them to expand out and set. The movement of sleeves 270 and 271 is delayed until after the setting of the dogs into the locked out mode by spacing shoulder 230*a*' and collar 273 from sleeves 270, 271, respectively. Initial movement of mandrel 230 relative to drag housing 262 and dogs 232 sets the dogs in to locked out mode and then continued movement sets seals 236. The simultaneous setting of seals can be achieved by selecting the spaces between shoulder 230*a*' and sleeve 270 and collar 273 and sleeve 271 to be substantially the same.

In this embodiment, biasing means such as springs 268*a*, 268*b* ensures that seals 236*a*, 236*b* and their compression surfaces are maintained closely spaced. The seals are unset by pulling up on the mandrel. When mandrel 230 is pulled up, pulling sleeves 280*a*, 280*b* are pulled up by shoulder 230*a*' and collar 273, respectively, to pull sleeves 270, 271 away from shoulders 262*a*, 262*b*. This allows the seals to relax. Pulling sleeves 280*a*, 280*b* engage with sleeves 270, 271 by interaction of returns on their overlapping ends. Pulling sleeves 280*a*, 280*b* have no effect on the setting of the packers, as they simply telescope into sleeves 270, 271.

Seals 236 straddle and are spaced from dogs 232 with consideration of the construction and size of the fluid port into which the dogs are intended to lock such that when the dogs are located in the shift gap, the seals are positioned to seal against a continuous surface such as along the wall of a tubular of the string rather than directly against the sliding sleeve valve. The seals may include a rating sufficient to withstand pressures associated with wellbore treatments such as greater than 2500 psi.

Also in the illustrated embodiment and as noted above, the tool may include fluid delivery openings 238*a* such that fluid may be delivered to the fluid port located by dogs 232. Fluid delivery openings 238*a* are positioned between seals 236 and adjacent dogs 232. As noted above, the tool body includes conduit 238, which is an inner bore through mandrel 230 and is accessed through an opening at upper end 230*a*. Fluid can be delivered to the conduit provided through the inner bore through the open end and the fluid passes out of the bore through fluid delivery openings 238*a* to the area of the tool adjacent the dogs, which will be that area positioned at the fluid ports. In this embodiment, fluid delivery openings 238*a* pass though back up insert 250 such that they are positioned directly in the spaces between adjacent dogs 232 when they are in the locked out mode.

The well bore in which the tool is positioned may be closed or closeable by upper annular seal 236*a* and lower annular seal 236*b* such that pressure isolation can be maintained at the dogs, when the seals are set. Fluid conveyed to the tool, therefore, exists in the isolated zone between the seals. The string on which the tool is carried can be a tubular string, such as coiled tubing or small diameter connected tubulars, so that fluid can be conveyed through the string to the inner bore of the tool.

In this embodiment, the tool includes a lower circulation valve through which fluid can be circulated below the seals, if desired. The lower circulation valve includes ports 282 in mandrel 230 that can be aligned with ports 284 in drag housing 262 to open the valve and can be positioned between bonded annular seals 286 on the inner bore of the drag housing to close the valve. When the mandrel is pushed down while the position of the housing 262 is locked in the string, ports 284 are positioned between seals 286 and the valve is closed. However, when mandrel is pulled up, or placed in the pushed down, inactive position, circulation valve remains open with communication between ports 282 and ports 284.

The tool may include pressure gauges and/or recorders adjacent the dogs to permit determination of dynamic downhole pressure numbers, measurements, etc. so that the pressure of each interval accessed through the port may be obtained.

In view of the foregoing there is provided a method for locating a fluid port in a tubing string, the fluid port being positioned in a shift gap, which presents a recess from the inner diameter of a tubing string, the method comprising: running a string with a tool thereon into a wellbore tubing string, the tool including a tool body and a plurality of dogs spaced apart about a circumference of the body and radially biased outwardly from the body, the dogs being configurable between an outwardly locked mode and a collapse mode; and moving the tool through the tubing string until the dogs anchor in the shift gap.

The tool is anchored into the shift gap while pushing the tool down through the string. The method can further include setting seals 236*a*, 236*b* to create an annular seal about the tool above and/or below the dogs. The seals can set after the dogs lock into a shift gap and can be set at about the same time. The method can include isolating the fluid port, testing the fluid port or through the fluid port, and/or injecting fluids from the tool through the fluid port. The method can further include pumping fluid out through the tool adjacent the dogs and, for example, may include pumping fluid out through the tool and directly radially out from below the dogs toward the located fluid port in the tubing string.

The method may include circulating through the tool below the lower packer and closing lower circulation when the dogs are locked into in a shift gap.

In one embodiment, a method includes:

1. Running the tool on a work string, the tool being in the push down, inactive position;
2. Running the dogs of the tool down past the shift gap in which the fluid port is positioned, the dogs collapsing to pass the shift gap on the way down;
3. Pull up on the string to move the dogs back up hole of the shift gap, which moves the tool through the J-keyway to the pull up position, and then push the tool down to move the tool into the push down, active position, as controlled by the J-keyway;
4. Continued downward movement locates the dogs in the fluid port shift gap;
5. Once the dogs snap into the shift gap, they are locked therein by the backup insert moving behind them;
6. With the dogs locked into the shift gap, push down or release weight into the tool to compress the seals;
7. Slacking off at surface to maintain weight on the tool during further operations to maintain the seals set;
8. Fluid operations can be conducted through the tool;
9. Pull up to release the tool and the tool will move automatically via the J-keyway to the pull up position with the dogs in the collapse mode and the seals retracted;
10. Pull up on the tool and pull it out of the hole or move it to the next fluid port;
11. If location in another shift gap is of interest, movement of the dogs through a shift gap can be sensed at surface and the tool can be pushed which places it in the push down, active position, as controlled by the J-keyway. Thereafter, repeat from step 4 for this and further shift gaps.

Further operations may include testing at the port, fluid injection at the port, etc.

In one method according to the present invention, the fluid treatment is borehole stimulation using stimulation fluids such as one or more of acid, gelled acid, gelled water, gelled oil, $CO_2$, nitrogen and any of these fluids containing proppants, such as for example, sand or bauxite.

The previous description of the disclosed embodiments is provided to enable any person skilled in the art to make or use the present invention. Various modifications to those embodiments will be readily apparent to those skilled in the art, and the generic principles defined herein may be applied to other embodiments without departing from the spirit or scope of the invention. Thus, the present invention is not intended to be limited to the embodiments shown herein, but is to be accorded the full scope consistent with the claims, wherein reference to an element in the singular, such as by use of the article "a" or "an" is not intended to mean "one and only one" unless specifically so stated, but rather "one or more". All structural and functional equivalents to the elements of the various embodiments described throughout the disclosure that are known or later come to be known to those of ordinary skill in the art are intended to be encompassed by the elements of the claims. Moreover, nothing disclosed herein is intended to be dedicated to the public regardless of whether such disclosure is explicitly recited in the claims. No claim element is to be construed under the provisions of 35 USC 112, sixth paragraph, unless the element is expressly recited using the phrase "means for" or "step for".

The invention claimed is:

1. A tool for locating a fluid port in a tubing string, the fluid port being positioned in a shift gap having a known axial length and an inner diameter greater than an inner diameter of the tubing string, the tool comprising: a body including an upper end, a lower end and an outer surface extending therebetween defining an outer diameter, a locking protrusion encircling a circumference of the body, the locking protrusion forming an annular protrusion on the tool with an axial length selected to be at least 60% of the known axial length, the locking protrusion being configurable between an outwardly locked mode and a collapse mode; and a setting mechanism to move the locking protrusion between the outwardly locked mode and the collapse mode.

2. The tool of claim 1 where the locking protrusion includes a plurality of dogs spaced apart about the circumference.

3. The tool of claim 1 wherein the setting mechanism is a back up insert moveable behind the locking protrusion to configure the locking protrusion in the outwardly locked mode.

4. The tool of claim 1 further comprising a conduit through the body from the upper end and an opening on an outer surface of the body.

5. The tool of claim 1 further comprising a lower annular seal about a circumference of the body positioned between the lower end and the locking protrusion.

6. The tool of claim 5 further comprising an upper annular seal about a circumference of the body positioned between the upper end and the locking protrusion.

7. The tool of claim 6 further comprising a conduit through the body from the upper end and an opening on an outer surface of the body, the opening positioned between the upper annular seal and the lower annular seal.

8. The tool of claim 7 wherein the opening is positioned radially inwardly of the locking protrusion, such that fluid passing therethrough moves directly radially out through the locking protrusion.

9. The tool of claim 5 wherein the tool is configured to set the lower annular seal only after the locking protrusion is moved into the locked out mode.

10. The tool of claim 6 wherein the tool is configured to set the lower annular seal and the upper annular seal only after the locking protrusion is moved into the locked out mode.

11. The tool of claim 6 wherein the tool is configured to set the lower annular seal and the upper annular seal at about the same time.

12. The tool of claim 1 wherein the tool is tension set.

13. The tool of claim 1 wherein the tool is compression set.

14. The tool of claim 1 wherein the outwardly locked mode locks the locking protrusion against lifting out of the shift gap.

15. A method for locating a fluid port in a tubing string, the fluid port being positioned in a shift gap from the inner diameter of a tubing string, the method comprising: determining an axial length of a shift gap in the tubing string; running a string with a tool thereon into a wellbore to approximately the depth of the fluid port, the tool including a tool body and a locking protrusion encircling a circumference of the body; locating the tool adjacent the shift gap; and locking the locking protrusion into the shift gap to hold the tool axially fixed within the tubing string.

16. The method of claim 15 wherein locating includes catching the tool in the shift gap as the tool is moved through the tubing string and sensing a resulting hesitation at surface.

17. The method of claim 15 wherein locating includes catching the locking protrusion in the shift gap as the tool is moved through the tubing string and sensing a resulting hesitation at surface.

18. The method of claim 15 wherein locking occurs by placing the tool in tension.

19. The method of claim 15 wherein locking occurs by placing the tool in compression.

20. The method of claim 15 further comprising creating an annular seal about the tool above and/or below the locking protrusion.

21. The method of claim 20 wherein creating an annular seal includes substantially simultaneously setting a seal above the locking protrusion and a seal below the locking protrusion.

22. The method of claim 15 further comprising creating an annular seal about the tool above and/or below the locking protrusion after locking.

23. The method of claim 15 further comprising providing fluid communication between surface operations and an area about the locking protrusion.

24. The method of claim 15 wherein the tubing string includes an annular recess having a diameter greater than the inner diameter and a shoulder defining an end of the annular recess where the inner diameter increases to the diameter and a sliding sleeve valve installed in the annular recess and being slidable between a position closing the fluid port and an open position wherein the fluid port is open to fluid flow therethrough between the inner diameter and the outer surface and the shift gap is located between the shoulder and the sliding sleeve valve in the open position; and wherein locking includes stopping the locking protrusion on the shoulder of the shift gap and thereby holding the tool against axial movement.

25. A wellbore assembly for fluid treatment of a well, the wellbore assembly comprising: a tubing string including a tubular wall including an outer surface and an inner wall surface defining an inner diameter, a fluid port extending through the tubular wall providing fluid access between the inner diameter and the outer surface, an annular recess in the inner wall surface, the annular recess having a diameter greater than the inner diameter and a shoulder defining an end of the annular recess where the inner diameter increases to the diameter, a sliding sleeve valve installed in the annular recess and being slidable between a position closing the fluid port and an open position wherein the fluid port is open to fluid flow therethrough between the inner diameter and the outer surface, the sliding sleeve valve in the open position creating a shift gap between the shoulder and the sleeve in which the fluid port is located, the shift gap having an axial length between the shoulder and the sleeve; and a tool for locating the fluid port in the tubing string, the tool including: a body including an upper end, a lower end and an outer surface extending therebetween defining an outer diameter, a locking protrusion encircling a circumference of the body, the locking protrusion having a length measured along the tool's long axis, the length being selected to fit into the shift gap without fitting into other profiles in the tubing string.

26. The wellbore assembly of claim 25 where the locking protrusion includes a plurality of dogs spaced apart about the circumference.

27. The wellbore assembly of claim 25 wherein the locking protrusion is configurable between an outwardly locked mode and a collapse mode; and the tool further comprises a setting mechanism to move the locking protrusion between the outwardly locked mode and the collapse mode.

28. The wellbore assembly of claim 27 wherein the setting mechanism is a back up insert moveable behind the locking protrusion to configure the locking protrusion in the outwardly locked mode.

29. The wellbore assembly of claim 25 further comprising a conduit through the body from the upper end and an opening on an outer surface of the body.

30. The wellbore assembly of claim 25 further comprising a lower annular seal about a circumference of the body positioned between the lower end and the locking protrusion.

31. The wellbore assembly of claim 30 further comprising an upper annular seal about a circumference of the body positioned between the upper end and the locking protrusion.

32. The wellbore assembly of claim 31 further comprising a conduit through the body from the upper end and an opening on an outer surface of the body, the opening positioned between the upper annular seal and the lower annular seal.

33. The wellbore assembly of claim 32 where the opening is positioned radially inwardly of the locking protrusion, such that fluid passing therethrough moves directly radially out through the locking protrusion.

34. The wellbore assembly of claim 31 wherein the tool is configured to set the lower annular seal and the upper annular seal only after the locking protrusion is moved into the locked out mode.

35. The wellbore assembly of claim 31 wherein the tool is configured to set the lower annular seal and the upper annular seal at about the same time.

36. The wellbore assembly of claim 30 wherein the tool is configured to set the lower annular seal only after the locking protrusion is moved into the locked out mode.

37. The wellbore assembly of claim 25 wherein the tool is tension set.

38. The wellbore assembly of claim 25 wherein the tool is compression set.

39. A method for locating a fluid port in a tubing string, the fluid port being positioned in a shift gap in the inner diameter of a tubing string, the method comprising: knowing an axial length of a shift gap in the tubing string, running a string with a tool thereon into a wellbore to approximately the depth of the fluid port, the tool including a tool body and a locking protrusion encircling a circumference of the body; locating the tool adjacent the shift gap; locking the locking protrusion into the shift gap; and creating annular seals about the tool above and below the locking protrusion, wherein the annular seals are created substantially simultaneously.

40. The method of claim 39 wherein locating includes catching the tool in the shift gap as the tool is moved through the tubing string and sensing a resulting hesitation at surface.

41. The method of claim 39 wherein locating includes catching the locking protrusion in the shift gap as the tool is moved through the tubing string and sensing a resulting hesitation at surface.

42. The method of claim 39 wherein locking occurs by placing the tool in tension.

43. The method of claim 39 wherein locking occurs by placing the tool in compression.

44. The method of claim 39 further comprising providing fluid communication between surface operations and an area about the locking protrusion.

45. A method for locating a fluid port in a tubing string, the fluid port being positioned in a shift gap from the inner diameter of a tubing string, the method comprising: knowing an axial length of a shift gap in the tubing string; running a string with a tool thereon into a wellbore to approximately the depth of the fluid port, the tool including a tool body and a locking protrusion encircling a circumference of the body; locating the tool adjacent the shift gap; locking the locking protrusion into the shift gap; and creating an annular seal about the tool above and/or below the locking protrusion after locking.

46. The method of claim 45 wherein locating includes catching the tool in the shift gap as the tool is moved through the tubing string and sensing a resulting hesitation at surface.

47. The method of claim 45 wherein locating includes catching the locking protrusion in the shift gap as the tool is moved through the tubing string and sensing a resulting hesitation at surface.

48. The method of claim 45 wherein locking occurs by placing the tool in tension.

49. The method of claim 45 wherein locking occurs by placing the tool in compression.

50. The method of claim 45 further comprising providing fluid communication between surface operations and an area about the locking protrusion.

51. A wellbore assembly for fluid treatment of a well, the wellbore assembly comprising: a tubing string including a tubular wall including an outer surface and an inner wall surface defining an inner diameter, a fluid port extending through the tubular wall providing fluid access between the inner diameter and the outer surface, a sliding sleeve valve slidable between a position closing the fluid port and an open position wherein the fluid port is open to fluid flow therethrough between the inner diameter and the outer surface, the sliding sleeve valve in the open position creating a shift gap in which the fluid port is located, the shift gap having an axial length; and a tool for locating the fluid port in the tubing string, the tool including: a body including an upper end, a lower end and an outer surface extending therebetween defining an outer diameter, a locking protrusion encircling a circumference of the body, at least a portion of the locking protrusion having a length measured along the tool's long axis, the length being selected to fit into the shift gap; and an upper annular seal about a circumference of the body positioned between the upper end and the locking protrusion.

52. The wellbore assembly of claim 51 where the locking protrusion includes a plurality of dogs spaced apart about the circumference.

53. The wellbore assembly of claim 51 wherein the tool is compression set.

54. The wellbore assembly of claim 51 further comprising a conduit through the body from the upper end and an opening on an outer surface of the body.

55. The wellbore assembly of claim 51 further comprising a lower annular seal about a circumference of the body positioned between the lower end and the locking protrusion.

56. The wellbore assembly of claim 55 further comprising a conduit through the body from the upper end and an opening on an outer surface of the body, the opening positioned between the upper annular seal and the lower annular seal.

57. The wellbore assembly of claim 56 where the opening is positioned radially inwardly of the locking protrusion, such that fluid passing therethrough moves directly radially out through the locking protrusion.

58. The wellbore assembly of claim 55 wherein the tool is configured to set the lower annular seal only after the locking protrusion is moved into the locked out mode.

59. The wellbore assembly of claim 51 wherein the tool is configured to set the upper annular seal only after the locking protrusion is moved into the locked out mode.

60. The wellbore assembly of claim 55 wherein the tool is configured to set the lower annular seal and the upper annular seal at about the same time.

61. The wellbore assembly of claim 51 wherein the tool is tension set.

62. The wellbore assembly of claim 51 wherein the locking protrusion is configurable between an outwardly locked mode and a collapse mode; and the tool further comprises a setting mechanism to move the locking protrusion between the outwardly locked mode and the collapse mode.

63. The wellbore assembly of claim 62 wherein the setting mechanism is a back up insert moveable behind the locking protrusion to configure the locking protrusion in the outwardly locked mode.

64. A wellbore assembly for fluid treatment of a well, the wellbore assembly comprising: a tubing string including a tubular wall including an outer surface and an inner wall surface defining an inner diameter, a fluid port extending through the tubular wall providing fluid access between the inner diameter and the outer surface, a sliding sleeve valve slidable between a position closing the fluid port and an open position wherein the fluid port is open to fluid flow therethrough between the inner diameter and the outer surface, the sliding sleeve valve in the open position creating a shift gap in which the fluid port is located, the shift gap having an axial length; and a tool for locating the fluid port in the tubing string, the tool including: a body including an upper end, a lower end and an outer surface extending therebetween defining an outer diameter, a locking protrusion encircling a circumference of the body, at least a portion of the locking protrusion having a length measured along the tool's long axis, the length being selected to fit into the shift gap and the locking protrusion is configurable between an outwardly locked mode and a collapse mode; and a setting mechanism to move the locking protrusion between the outwardly locked mode and the collapse mode, wherein the setting mechanism is a back up insert moveable behind the locking protrusion to configure the locking protrusion in the outwardly locked mode.

65. The wellbore assembly of claim 64 where the locking protrusion includes a plurality of dogs spaced apart about the circumference.

66. The wellbore assembly of claim 64 further comprising a conduit through the body from the upper end and an opening on an outer surface of the body.

67. The wellbore assembly of claim 64 further comprising a lower annular seal about a circumference of the body positioned between the lower end and the locking protrusion.

68. The wellbore assembly of claim 67 further comprising an upper annular seal about a circumference of the body positioned between the upper end and the locking protrusion.

69. The wellbore assembly of claim 68 further comprising a conduit through the body from the upper end and an opening on an outer surface of the body, the opening positioned between the upper annular seal and the lower annular seal.

70. The wellbore assembly of claim 69 where the opening is positioned radially inwardly of the locking protrusion, such that fluid passing therethrough moves directly radially out through the locking protrusion.

71. The wellbore assembly of claim 67 wherein the tool is configured to set the lower annular seal only after the locking protrusion is moved into the locked out mode.

72. The wellbore assembly of claim 68 wherein the tool is configured to set the lower annular seal and the upper annular seal only after the locking protrusion is moved into the locked out mode.

73. The wellbore assembly of claim 68 wherein the tool is configured to set the lower annular seal and the upper annular seal at about the same time.

74. The wellbore assembly of claim 64 wherein the tool is tension set.

75. The wellbore assembly of claim 64 wherein the tool is compression set.

* * * * *